US009623948B1

(12) United States Patent
Waldvogel et al.

(10) Patent No.: US 9,623,948 B1
(45) Date of Patent: Apr. 18, 2017

(54) STERN DRIVES FOR MARINE VESSELS

(71) Applicant: Brunswick Corporation, Lake Forest, IL (US)

(72) Inventors: David J. Waldvogel, Fond du Lac, WI (US); John A. Groeschel, Theresa, WI (US); Jeffrey C. Etapa, Elkhart Lake, WI (US)

(73) Assignee: Brunswick Corporation, Lake Forest, IL (US)

( * ) Notice: Subject to any disclaimer, the term of this patent is extended or adjusted under 35 U.S.C. 154(b) by 71 days.

(21) Appl. No.: 14/714,418

(22) Filed: May 18, 2015

(51) Int. Cl.

| | |
|---|---|
| ***B63H 20/22*** | (2006.01) |
| ***B63H 21/30*** | (2006.01) |
| ***B63H 5/125*** | (2006.01) |
| ***B63H 23/02*** | (2006.01) |

(52) U.S. Cl.
CPC ..... *B63H 21/305* (2013.01); *B63H 5/1252* (2013.01); *B63H 23/02* (2013.01); *B63H 20/22* (2013.01)

(58) Field of Classification Search
CPC .. B63H 20/32; B63H 2020/323; B63H 20/06; B63H 20/22; B63H 20/10; B63H 20/12; B63H 21/305; B63H 5/1252
See application file for complete search history.

(56) References Cited

U.S. PATENT DOCUMENTS

| | | | | |
|---|---|---|---|---|
| 5,238,433 | A * | 8/1993 | Hayasaka | B63H 20/06 440/57 |
| 5,707,263 | A * | 1/1998 | Eick | B63H 20/10 440/61 F |
| 6,454,620 | B1 * | 9/2002 | Theisen | B63H 20/10 114/150 |

OTHER PUBLICATIONS

Unpublished U.S. Appl. No. 14/267,441, filed May 1, 2014.
Unpublished U.S. Appl. No. 14/287,888, filed May 27, 2014.
Unpublished U.S. Appl. No. 14/560,550, filed Dec. 4, 2014.
Unpublished U.S. Appl. No. 14/614,773, filed Feb. 5, 2015.

* cited by examiner

*Primary Examiner* — Andrew Polay
(74) *Attorney, Agent, or Firm* — Andrus Intellectual Property Law, LLP

(57) ABSTRACT

A stern drive for a marine vessel comprises a gimbal housing that is configured for connection to the transom of the marine vessel; a gimbal ring that is steerable with respect to the gimbal housing about a vertical steering axis; a drive leg that is trimmable with respect to the gimbal ring about a horizontal trim axis, wherein the drive leg supports a propulsor for propelling the marine vessel; a trim actuator that is configured to trim the drive leg about the trim axis; and a cradle that decouples the drive leg from the transom of the marine vessel and pivots with and supports the drive leg and as the trim actuator trims the drive leg about the trim axis.

16 Claims, 4 Drawing Sheets

STERN DRIVES FOR MARINE VESSELS

FIELD

The present disclosure relates to stern drives and apparatuses for mounting stern drives to marine vessels.

BACKGROUND

The following U.S. patent applications are incorporated herein by reference, in entirety.

U.S. patent application Ser. No. 14/267,441 discloses apparatuses for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member that is disposed between the inner and outer clamping plates. A first connector extends through the hull and clamps the outer clamping plate to the outside surface of the hull. A second connector extends through the hull and clamps the inner clamping plate to the outer clamping plate. The inner and outer clamping plates are held at a fixed distance from each other so that a consistent compression force is applied to the vibration dampening sealing member.

U.S. patent application Ser. No. 14/287,888 discloses a stern drive for a marine vessel that includes an internal combustion engine, a flywheel housing located on the internal combustion engine, and a conduit formed through the flywheel housing. The conduit receives and discharges exhaust gases from the internal combustion engine. The flywheel housing can have an inner mounting face for connection to an engine block of the internal combustion and an outer mounting face for connection to a gimbal housing. The inner mounting face and outer mounting face are on opposite axial sides of the flywheel housing. The conduit includes an inlet port through which the exhaust gases are received from the internal combustion engine and an outlet port through which the exhaust gases are discharged from the flywheel housing. The inlet port can be located between the inner and outer mounting faces.

U.S. patent application Ser. No. 14/560,550 discloses a stern drive for a marine vessel. In certain examples, the stern drive comprises a gimbal housing that is configured for connection to the marine vessel, a gimbal ring that is steerable with respect to the gimbal housing about a vertical steering axis, a driveshaft housing that is connected to the gimbal ring, and a trim actuator that is configured to trim the driveshaft housing about a horizontal trim axis. The trim actuator has a first end that is pivotably connected to the gimbal ring at a horizontal first pivot axis and a second end that is pivotably connected to the driveshaft housing at a horizontal second pivot axis. A resilient driveshaft housing vibration isolator is located along the second pivot axis. The resilient vibration isolator isolates vibration forces on the driveshaft housing. A resilient gimbal ring vibration isolator is located along the trim axis. The gimbal ring vibration isolator isolates vibration forces on the gimbal ring. The stern drive has a center of gravity that is located between the gimbal ring vibration isolator and the trim actuator vibration isolator. The gimbal ring vibration isolator can comprise port and starboard gimbal ring vibration isolators, wherein the center of gravity is further located between the port and starboard gimbal ring vibration isolators. The gimbal ring vibration isolator and the trim actuator resilient vibration isolator operate together to isolate vibration forces on the stern drive.

U.S. patent application Ser. No. 14/614,773 discloses systems and methods for combined control of steering and trim of a marine engine unit. The systems and methods include a steering apparatus generating steering signals, a trim control generating trim signals, an electronic unit receiving steering trim and cylinder position signals and sending output signals. A port hydraulic cylinder and a starboard hydraulic cylinder that extend and retract are included. The cylinders connected to first and second port and starboard joints to provide movement of the engine unit. Position sensors operatively connected to each of the port hydraulic cylinder and the starboard hydraulic cylinder generate the position signals. A hydraulic manifold having solenoid controlled valves receives signals from the electronic control unit and operates to extend and retract the cylinders. The solenoid valves receive output signals from the control unit to extend or retract the port hydraulic cylinder and the starboard hydraulic cylinder and the first and second port and starboard joints enable movement of the engine unit vertically and horizontally when the port and starboard hydraulic cylinders are extended and retracted to provide a full range of steering and trim movement of an engine unit using only two hydraulic cylinders.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, stern drives for marine vessels comprise a gimbal housing that is configured for connection to the transom of the marine vessel; a gimbal ring that is steerable with respect to the gimbal housing about a vertical steering axis; and a drive leg that is trimmable with respect to the gimbal ring about a horizontal trim axis. The drive leg supports a propulsor for propelling the marine vessel. A trim actuator is configured to trim the drive leg about the trim axis. A cradle is provided that decouples the drive leg from the transom of the marine vessel and pivots with and supports the drive leg and as the trim actuator trims the drive leg about the trim axis.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
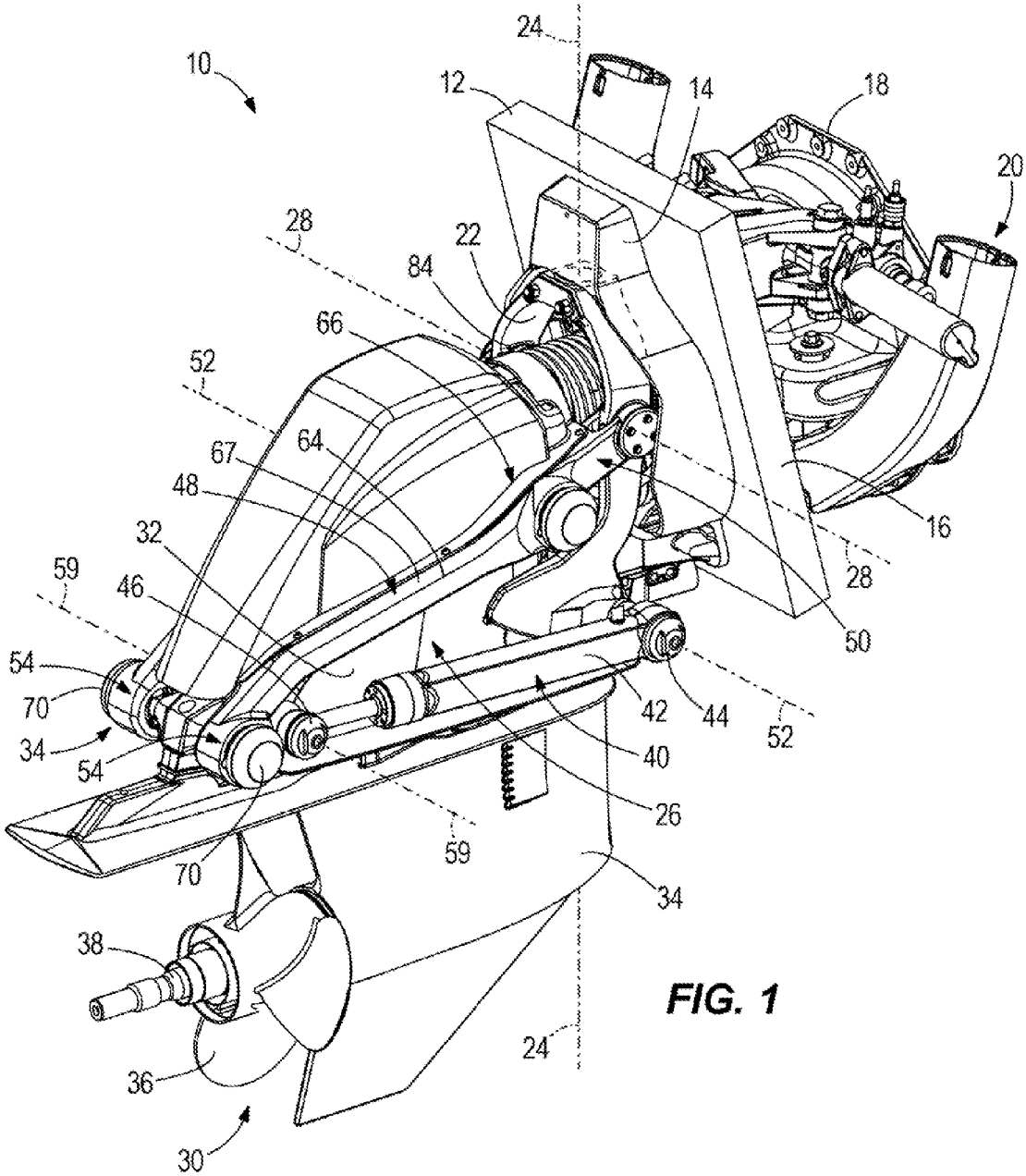
FIG. 1 is a perspective view of a stern drive for a marine vessel.

Through research and development, the present inventors have determined that conventional stern drive arrangements typically rigidly attach the drive leg to the transom of the marine vessel, with minimal vibration isolation provided.

Due to the rigid attachment, vibrations from the drive leg are directly transmitted through the boat hull, causing undesirable noise and vibration for the end user. As such, the present inventors endeavored to provide stern drive arrangements wherein the drive leg, including the drive shaft housing and gearcase, are isolated from the rest of the drive and the marine vessel via for example rubber isolators. The inventors have further endeavored to provide a unique cradle device that is attached to the gimbal ring. The cradle houses rubber isolators and pivots with the gimbal ring and tilts up and down with the drive leg. The rubber isolators connect the drive shaft housing to the cradle. Advantageously, embodiments disclosed herein can maintain steering and tilt features of the stern drive on a rigidly attached structure, yet isolate the drive leg from the marine vessel, thus minimizing transfer of noise and vibration.

FIGS. 1-4 depict one example of a stern drive 10 for a marine vessel 12 according to the present disclosure. The stern drive 10 has a gimbal housing 14 that is connected to a transom 16 of the marine vessel 12. The configuration of the gimbal housing 14 and the manner in which the gimbal housing 14 is connected to the transom 16 can vary from that which is shown. Examples of suitable gimbal housings are disclosed in the incorporated U.S. patent application Ser. No. 14/267,441. The stern drive 10 further includes a flywheel housing 18 and exhaust system 20, which are disposed inside the marine vessel 12. The configuration of the flywheel housing 18 and exhaust system 20 can vary from that shown and optionally can be configured in the manner disclosed in the incorporated U.S. patent application Ser. Nos. 14/287,888 and/or 14/560,550. The stern drive 10 further includes a gimbal ring 22, which is steerable with respect to the gimbal housing 14 about a vertical steering axis 24 by a conventional electric, mechanical, and/or hydraulic steering actuator. The gimbal ring 22 has an oval ring shape. The noted vertical steering axis 24 vertically extends through top and bottom of the oval ring shape. The stern drive 10 further includes a drive leg 26, which is trimmable with respect to the gimbal ring 22 about a horizontal trim axis 28 that is perpendicular to the vertical steering axis 24 and extends through the gimbal ring 22. Trimming movement of the drive leg 26 about the trim axis 28 is illustrated by comparison of FIGS. 3 and 4.

In the illustrated example, the drive leg 26 supports a propulsor 30 for propelling the marine vessel 12 in a conventional manner. The drive leg 26 has a driveshaft housing 32 and a gearcase 34 that extends from the driveshaft housing 32. The propulsor 30 extends from the gearcase 34 and in this example includes a propeller 36 that is driven into rotation by a propeller shaft 38. The type and configuration of the propulsor 30 can vary from that which is shown and can include for example more than one propeller, counter-rotating propellers, and/or the like.

A trim actuator 40 is configured to trim the drive leg 26 about the trim axis 28. The type of trim actuator 40 can vary from that which is shown and can include one or more conventional mechanical, electric and/or hydraulic devices. In this example, the trim actuator 40 includes conventional piston-cylinders 42 that are disposed on opposite sides (i.e. port and starboard sides) of the stern drive 10. The piston-cylinders 42 are hydraulically actuated in a conventional manner to move between a retracted position (shown in FIG. 3) wherein the stern drive 10 is trimmed down and an extended position (shown in FIG. 4) wherein the stern drive 10 is trimmed up. Each piston-cylinder 42 has a first end 44 that is connected to the gimbal ring 22 at a first pivot axis 52 and an opposite, second end 46 that is connected to a cradle 48 at a second pivot axis 59. The cradle 48 decouples and supports the stern drive 10 with respect to the transom 16. The structure and function of the cradle 48 is further described herein below.

Figure 3:
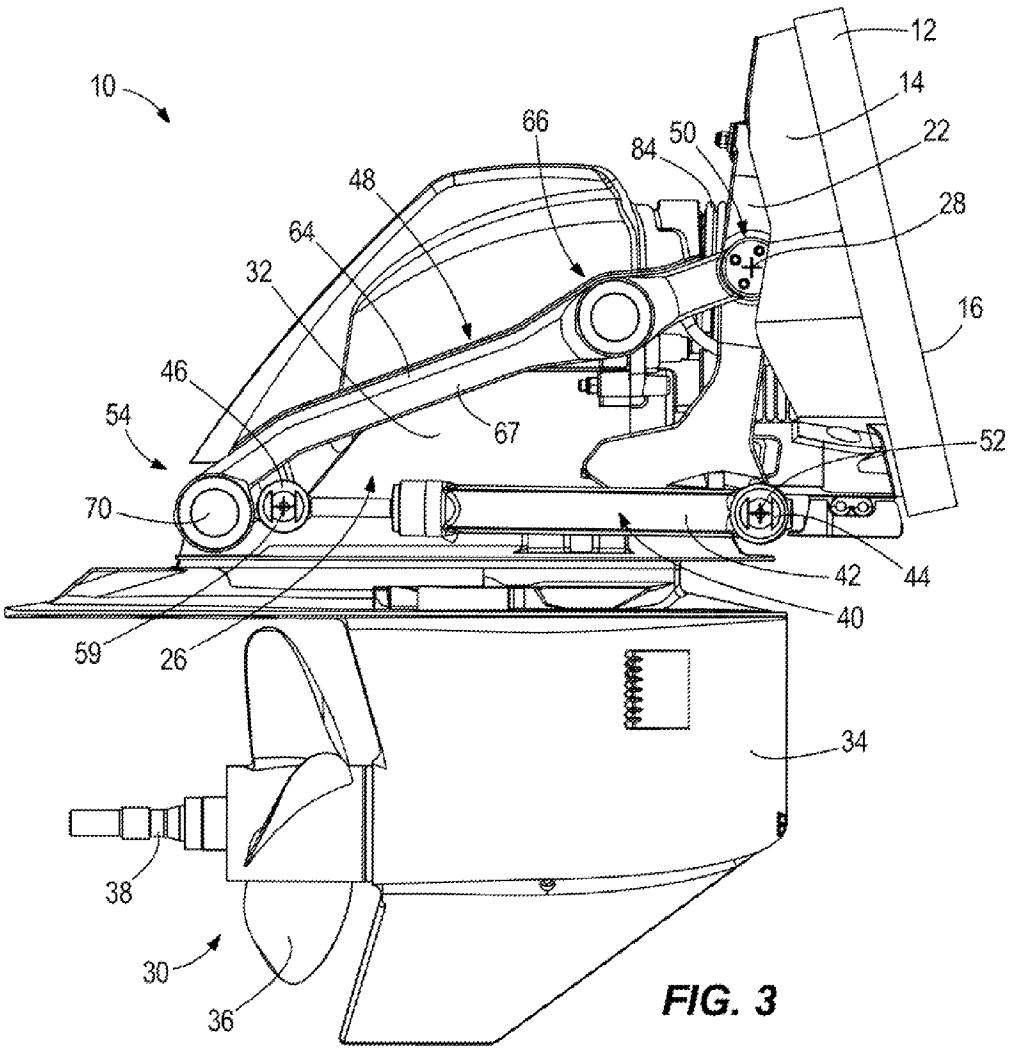
FIG. 3 is a side view of the stern drive in a trimmed down position.
Figure 4:
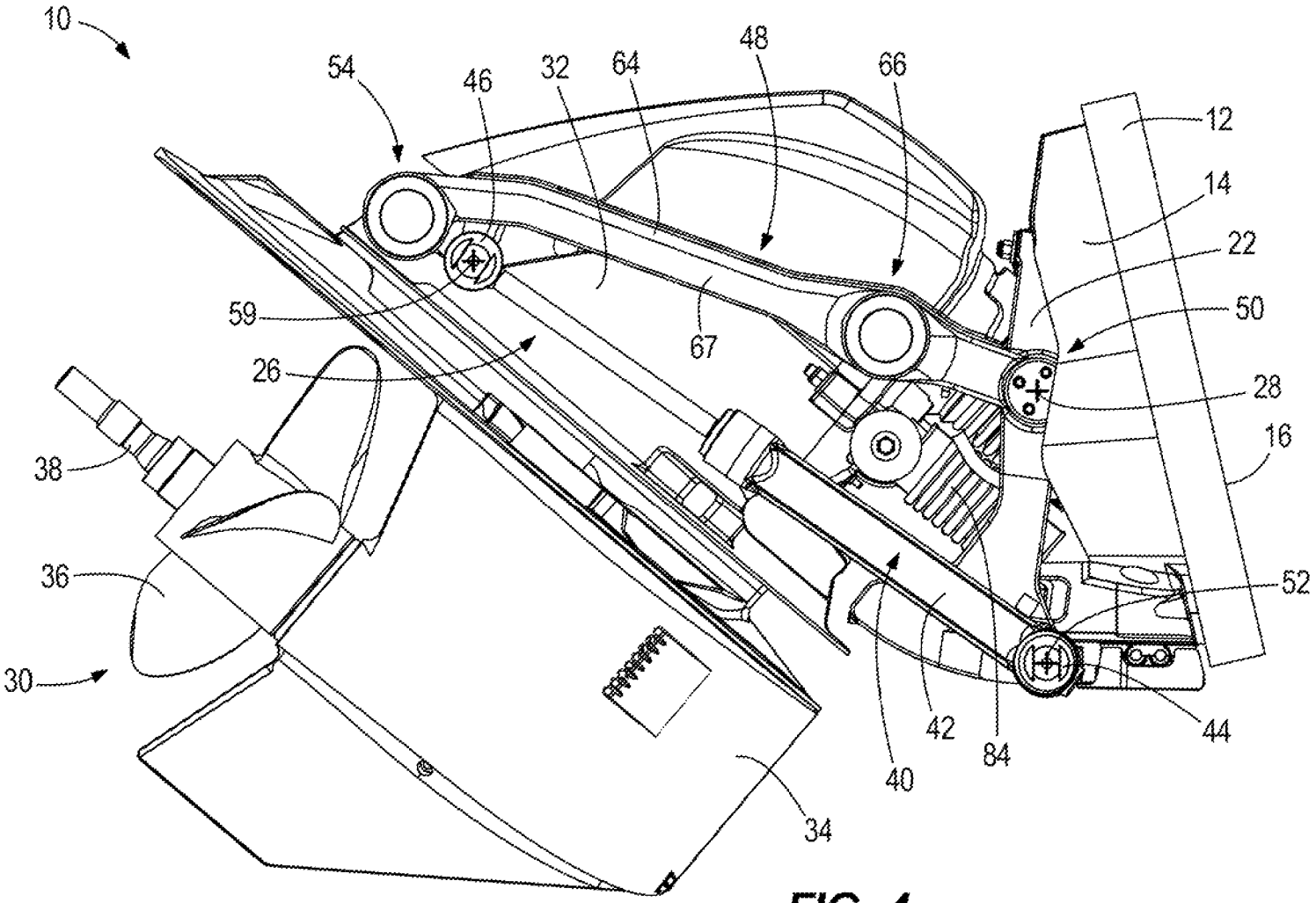
FIG. 4 is a side view of the stern drive in a trimmed up position.

The cradle 48 is a rigid member that pivots with the drive leg 26 about the trim axis 28 as the trim actuator 40 trims the drive leg 26 (compare FIGS. 3 and 4). Advantageously, the cradle 48 effectively decouples the drive leg 26 from the transom 16 of the marine vessel 12 to thereby limit transmission of vibrations from the drive leg 26 to the transom 16. In the illustrated example, the cradle 48 has a first end portion 50 that is connected to the gimbal ring 22 and an opposite second end portion 54 that is connected to the drive leg 26. The cradle 48 further includes a middle portion 66 that is located between the first and second end portions 50, 54. The middle portion 66 is also connected to the drive leg 26. The noted second ends 46 of the piston-cylinders 42 are connected to the cradle 48 aftwardly of the second end portion 54 of the cradle 48 at the second pivot axis 59.

The geometry of the cradle 48 can vary from that which is shown. In the illustrated example, the cradle 48 includes a rigid, monolithic frame 64 having first and second supporting arms 67 that are disposed on opposite sides (i.e. port and starboard sides) of the drive leg 26. A transversely extending support member (i.e. cross member) 68 is located near the second end portion 54 and connects the first and second supporting arms 67 together. The driveshaft housing 32 is disposed between the supporting arms 67. As explained further herein below, the respective ends of the supporting arms 67 retain vibration dampening members for further limiting the transfer of vibration from the drive leg 26 to the transom 16.

Referring to FIGS. 3 and 4, the first ends 44 of the piston-cylinders 42 are pivotably connected to the gimbal ring 22 at the first pivot axis 52. The second ends 46 of the piston-cylinders 42 are pivotably connected to the second end portion 54 of the cradle 48 at the second pivot axis 59. The first pivot axis 52 is located vertically lower the trim axis 28. The trim axis 28 is located vertically higher than the first ends 44 of the piston-cylinders 42. The second ends 46 of the piston-cylinders 42 are located aftwardly of the trim axis 28 and aftwardly of the first ends 44 of the piston-cylinders 42.

Figure 2:
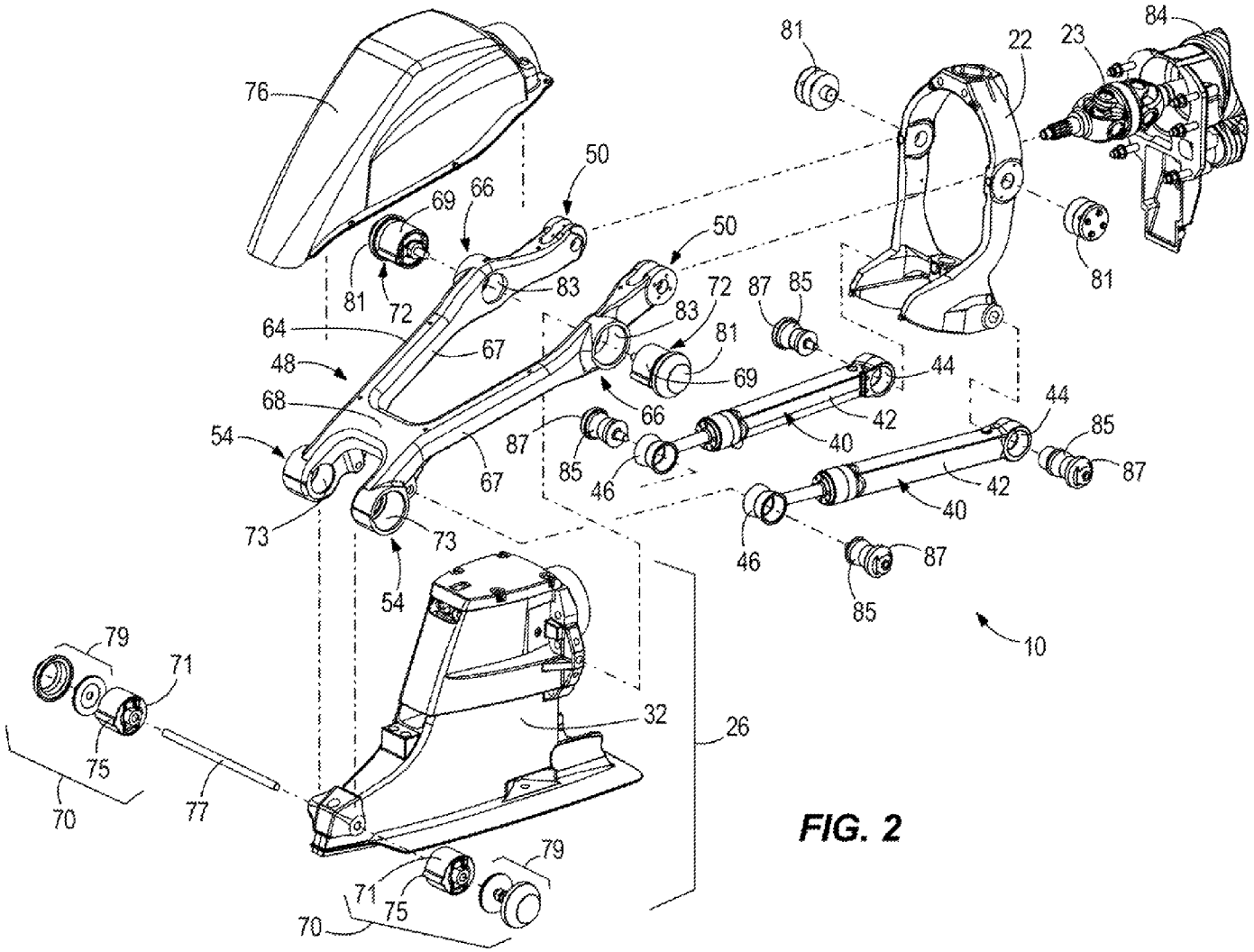
FIG. 2 is an exploded view of the stern drive.

Referring to FIG. 2, elastic vibration dampening mounts 70 are disposed between the drive leg 26 and the second end portion 54 of the cradle 48. The configuration of the elastic vibration dampening mounts 70 can vary. In one example, each elastic vibration dampening mount 70 includes a cylindrical rubber isolator 71 surrounded by a cylindrical outer shell 73 formed by the cradle 48. Each vibration dampening mount 70 can further include an anti-rotation feature to prevent relative rotation between the rubber isolator 71 and the outer shell 73. The anti-rotation feature also provides for control and tuning of stiffness and orientation within the rubber isolator 71. In the illustrated example the anti-rotation feature is provided by an axially extending ridge 75 disposed on the outer surface of the rubber isolator 71. The ridge 75 is received in a corresponding radially inwardly facing groove in the outer shell 73. The rubber isolators 71 are mounted on a central mounting shaft 77 and end washers/caps 79 retain the rubber isolators 71 on the shaft 77.

Elastic vibration dampening mounts 72 having rubber isolators 69 are disposed between the drive leg 26 and the middle portion 66 of the cradle 48. Stub shaft and end caps 81 retain the elastic vibration dampening mounts 72 in outer shells 83 formed in the middle portion 66 of the cradle 48. Vibration isolators 85 can also be disposed at the first and second ends 44, 46 of the piston-cylinders 42 to further limit transmission of vibration to the transom 16 via the piston-cylinders 42. In this example, stub shaft and end caps 87 pivotably connect the first and second ends 44, 46 of the piston-cylinders 42 to the gimbal ring 22 and cradle 48, respectively.

A driveshaft housing cover 76 is provided on the driveshaft housing 32. Optionally the cover 76 and/or driveshaft housing 32 can have passages for conveying cooling fluid for cooling drive components in the driveshaft housing 32. The cover 76 is connected to the cradle 48 and is supported with respect to the driveshaft housing 32 via the cradle 48. The drive leg 26 can further include a flexible bellows 84 that extends through the gimbal ring 22 and covers drive components of the stern drive 10, such as the Double Cardan Joint 23 (FIG. 2).

Advantageously, the drive leg 26 is isolated from the marine vessel 12 by the cradle 48. That is, the drive leg 26 is only indirectly supported by the marine vessel 12 via the cradle 48. In certain examples, the drive leg 26 is further isolated from the rest of the stern drive 10 and transom 16 via vibration dampening isolators 71, 72, 85. Certain vibration dampening isolators 71, 72, 85 are housed in the cradle 48, which is attached to the gimbal ring 22. The cradle 48 pivots about the vertical steering axis 24 with the gimbal ring 22 and tilts up and down with the drive leg 26 about the trim axis 28. The piston-cylinders 42 are pivotably connected to the cradle 48 and gimbal ring 22. The vibration dampening isolators 71, 72, 85 are attached to the drive leg 26 through the cradle 48, which is attached to the gimbal ring 22. This isolates the drive leg 26 and prevents vibrations from the drive leg 26 to the rest of the marine vessel 12. The vibration dampening isolators 71, 72, 85 maintain alignment within the stern drive 10 to thereby preserve life of the Double Cardan Joint 23 and to react to thrust and hydrodynamic loads of the drive leg 26.

Advantageously, the invention can be retrofitted to current production stern drives without needing to change the cutout hole in the marine vessel 12 or transom 16, or the configuration of the stern drive 10. For example, isolation can be achieved without having to change the size of the cutout in the transom 16 or the gimbal housing 14. In the illustrated example, a moment arm between the propeller shaft 38 or other thrust location and the vibration dampening isolators 71, 72, 85 will cause the drive leg 26 to pivot relative to the cradle 48. Pivoting of the drive leg 26 will occur about an elastic axis that exists somewhere between the vibration dampening isolators 71, 72, 85. The location and orientation of the vibration dampening isolators 71, 72, 85 can vary from that which is shown, and in certain examples could connect to the drive leg 26 in the vertical direction. Preferably the location and orientation of the vibration dampening isolators 71, 72, 85 are selected so as to prevent displacement of the Double Cardan Joint 23.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A stern drive for a marine vessel, the stern drive comprising:

a gimbal housing that is configured for connection to the transom of the marine vessel;

a gimbal ring that is steerable with respect to the gimbal housing about a vertical steering axis;

a drive leg that is trimmable with respect to the gimbal ring about a horizontal trim axis that is perpendicular to the vertical steering axis, wherein the drive leg supports a propulsor for propelling the marine vessel;

a trim actuator that is configured to trim the drive leg about the horizontal trim axis; and a cradle that supports the drive leg with respect to the gimbal ring and pivots with the drive leg and as the trim actuator trims the drive leg about the horizontal trim axis, wherein the cradle decouples the drive leg from the transom of the marine vessel;

wherein the cradle comprises a first end portion that is pivotably connected to the gimbal ring at the trim axis and an opposite, second end portion that is connected to the drive leg;

an elastic vibration dampening isolator disposed between the drive leg and the second end portion of the cradle; and an elastic vibration dampening isolator disposed between the drive leg and the middle portion of the cradle.

2. The stern drive according to claim 1, wherein the elastic vibration dampening isolator comprises a rubber mount.

3. The stern drive according to claim 1, wherein the elastic vibration dampening isolator comprises a rubber mount.

4. A stern drive for a marine vessel, the stern drive comprising:

a gimbal housing that is configured for connection to the transom of the marine vessel;

a gimbal ring that is steerable with respect to the gimbal housing about a vertical steering axis;

a drive leg that is trimmable with respect to the gimbal ring about a horizontal trim axis that is perpendicular to the vertical steering axis, wherein the drive leg supports a propulsor for propelling the marine vessel;

a trim actuator that is configured to trim the drive leg about the horizontal trim axis; and a cradle that supports the drive leg with respect to the gimbal ring and pivots with the drive leg and as the trim actuator trims the drive leg about the horizontal trim axis, wherein the cradle decouples the drive leg from the transom of the marine vessel;

wherein the cradle comprises a first end portion that is pivotably connected to the gimbal ring at the trim axis and an opposite, second end portion that is connected to the drive leg;

wherein the cradle further comprises a frame having first and second supporting arms that are disposed on opposite sides of the drive leg.

5. The stern drive according to claim 4, wherein the frame further comprises a cross-member that connects the first and second supporting arms together.

6. A stern drive for a marine vessel, the stern drive comprising:

a gimbal housing that is configured for connection to the transom of the marine vessel;

a gimbal ring that is steerable with respect to the gimbal housing about a vertical steering axis;

a drive leg that is trimmable with respect to the gimbal ring about a horizontal trim axis that is perpendicular to the vertical steering axis, wherein the drive leg supports a propulsor for propelling the marine vessel;

a trim actuator that is configured to trim the drive leg about the horizontal trim axis; and a cradle that supports the drive leg with respect to the gimbal ring and pivots with the drive leg and as the trim actuator trims the drive leg about the horizontal trim axis, wherein the cradle decouples the drive leg from the transom of the marine vessel;

wherein the cradle comprises a first end portion that is pivotably connected to the gimbal ring at the trim axis and an opposite, second end portion that is connected to the drive leg;

wherein the drive leg comprises a driveshaft housing and a gearcase housing that extends from the driveshaft housing, wherein the propulsor extends from the gearcase housing.

7. The stern drive according to claim 6, wherein the cradle further comprises a middle portion that is located between the first and second end portions, wherein the middle portion is connected to the drive leg.

8. The stern drive according to claim 6, wherein the trim actuator comprises a piston-cylinder having a first end that is pivotably connected to the gimbal ring and a second end that is pivotably connected to the second end portion of the cradle.

9. The stern drive according to claim 8, further comprising an elastic vibration dampening isolator that is disposed between the first end of the piston-cylinder and the gimbal ring and an elastic vibration dampening isolator that is disposed between the second end of the piston-cylinder and the cradle.

10. The stern drive according to claim 6, wherein the trim axis is located vertically higher than the first end of the piston-cylinder.

11. The stern drive according to claim 10, wherein the second end of the piston-cylinder is located aftwardly of the trim axis and aftwardly of the first end of the piston-cylinder.

12. The stern drive according to claim 11, wherein the trim actuator comprises a piston-cylinder having a first end that is connected to the gimbal ring and a second end that is connected to the cradle, forwardly of the second end portion of the cradle.

13. The stern drive according to claim 6, wherein the drive leg is separated from the transom and is only indirectly supported by the marine vessel via the cradle.

14. The stern drive according to claim 6, comprising a cover for the driveshaft housing, wherein the cover is connected to the cradle and supported with respect to the driveshaft housing via the cradle.

15. The stern drive according to claim 6, further comprising a flexible bellows that extends through the gimbal ring, wherein the flexible bellows contains drive components for the stern drive.

16. A stern drive for a marine vessel, the stern drive comprising:

a gimbal housing that is configured for connection to the transom of the marine vessel;

a gimbal ring that is steerable with respect to the gimbal housing about a vertical steering axis;

a drive leg that is trimmable with respect to the gimbal ring about a horizontal trim axis that is perpendicular to the vertical steering axis, wherein the drive leg supports a propulsor for propelling the marine vessel;

a trim actuator that is configured to trim the drive leg about the horizontal trim axis;

a cradle that supports the drive leg with respect to the gimbal ring and pivots with the drive leg and as the trim actuator trims the drive leg about the horizontal trim axis, wherein the cradle decouples the drive leg from the transom of the marine vessel;

wherein the cradle comprises a first end portion that is pivotably connected to the gimbal ring at the trim axis and an opposite, second end portion that is connected to the drive leg;

wherein the cradle further comprises a middle portion that is located between the first and second end portions, wherein the middle portion is connected to the drive leg;

a first elastic vibration dampening isolator disposed between the drive leg and the second end portion of the cradle; and a second elastic vibration dampening isolator disposed between the drive leg and the middle portion of the cradles.

* * * * *